US005352115A

United States Patent [19]

Klobucar

[11] Patent Number: 5,352,115

[45] Date of Patent: Oct. 4, 1994

[54] REGENERATIVE THERMAL OXIDIZER WITH HEAT EXCHANGER COLUMNS

[75] Inventor: Joseph M. Klobucar, Plymouth, Mich.

[73] Assignee: Durr Industries, Inc., Plymouth, Mich.

[21] Appl. No.: 89,722

[22] Filed: Jul. 12, 1993

[51] Int. Cl.[5] ..... F27D 17/00

[52] U.S. Cl. ..... 432/181; 110/233; 110/211; 432/179

[58] Field of Search ..... 110/211, 233; 432/179–181

[56] References Cited

U.S. PATENT DOCUMENTS

| | | | |
|---|---|---|---|
| 3,692,095 | 9/1972 | Fleming | 165/4 |
| 4,558,731 | 12/1985 | Pentikainen . | |
| 4,624,305 | 11/1986 | Rojey | 165/165 |
| 4,705,097 | 11/1987 | Mita et al. | 165/4 |
| 4,771,826 | 9/1988 | Grehier et al. | 165/166 |
| 4,776,387 | 10/1988 | Newman | 165/76 |
| 4,901,787 | 2/1990 | Zornes | 165/4 |
| 5,025,856 | 6/1991 | VanDyke et al. | 165/167 |
| 5,026,277 | 6/1991 | York | 432/181 |
| 5,092,767 | 3/1992 | Dehlsen | 432/181 |
| 5,098,286 | 3/1992 | York | 432/181 |
| 5,101,741 | 4/1992 | Gross et al. | 110/233 |
| 5,129,332 | 7/1992 | Greco | 110/233 |

*Primary Examiner*—Henry C. Yuen
*Attorney, Agent, or Firm*—Howard & Howard

[57] ABSTRACT

A regenerative thermal oxidizer having regenerative heat exchangers includes a heat exchange column formed of a body which defines at least one entire flow passage through the heat exchanger. The heat exchange column assists in purging residual gas to be cleaned from the heat exchanger prior to that regenerative heat exchanger moving into a mode where it receives the cleaned gas. This reduces inadvertent emissions of gas to be cleaned to the environment. In one embodiment, a monolithic body includes all of the flow passages. In a second embodiment, a plurality of blocks are utilized to form the heat exchanger column. In a third embodiment, a number of cylindrical tubes are utilized. The heat exchanger columns preferably have 70 to 80 percent of their surface area used as the flow passages.

17 Claims, 2 Drawing Sheets

REGENERATIVE THERMAL OXIDIZER WITH HEAT EXCHANGER COLUMNS

This application in general relates to a regenerative thermal oxidizer of the type having a plurality of heat exchangers leading into a common combustion chamber. The heat exchangers associated with the regenerative thermal oxidizer are preferably formed of any one of several embodiments having a solid body which defines at least one entire flow passage.

BACKGROUND OF THE INVENTION

In the prior art, regenerative thermal oxidizers are known for oxidizing pollutants, such as hydrocarbon vapors in air, and converting the pollutants into carbon dioxide and water vapor. Typically, a pollutant laden "dirty" gas to be cleaned is directed into a combustion chamber and through a previously heated regenerative heat exchanger. At the same time, a previously combusted hot "clean" gas is directed out of the combustion chamber and into a second heat exchanger. The gas to be cleaned leading into the combustion chamber is heated as it passes through the previously heated heat exchanger, while the gas which has been combusted is passing out through the second heat exchanger, heating the second heat exchanger. In this way, regenerative thermal oxidizers continuously operate to combust or oxidize a gas to be cleaned. By alternating the flow of cool gas to be cleaned through a hot heat exchanger, then moving hot gas from the combustion chamber outwardly through a heat exchanger, each heat exchanger is periodically alternatively heated and cooled.

Known regenerative thermal oxidizers have valving systems which periodically switch the inlet flow of gas to be cleaned between the several heat exchangers, and periodically switch the outlet flow of clean gas between the several heat exchangers. Thus, each heat exchanger is periodically moved from receiving gas to be cleaned, which is heated by the heat exchanger, and then subsequently receives a combusted clean gas which heats the heat exchanger.

A problem exists with the prior art devices in that when a particular heat exchanger is initially switched from receiving a gas to be cleaned to receiving a gas which was cleaned, there is residual dirty gas to be cleaned remaining in the heat exchange structure, which will be exhausted to the environment.

The prior art regenerative thermal oxidizers typically have utilized a plurality of small pieces of ceramic material as heat exchange media. Typically, the heat exchanges for regenerative thermal oxidizers have included one inch ceramic saddle-shaped pieces, or irregular mineral spheroids or gravel. The saddles or spheroids are poured into a regenerator shell and raked to a uniform depth. The individual pieces of the heat exchange media remain in whatever orientation they happen to fall into when the regenerator shell is filled. The resistance to gas flow or pressure drop through the heat exchange media is relatively high and will vary through the heat exchange media, depending upon the random orientation of the media and, to some extent, the degree of contamination. In a typical regenerator having randomly oriented saddle-shaped pieces, the overall pressure drop will be about ten inches of water, or greater.

As mentioned above, problems remain with such heat exchangers in that when a particular heat exchanger is initially switched from receiving a gas to be cleaned to receiving a gas which is cleaned and is to be delivered to an outlet, any residual inlet, or "dirty" gas to be cleaned remaining in the heat exchange medium will be delivered to the outlet as clean gas. When the particular heat exchanger is initially switched into a mode of receiving a clean gas, that clean gas will entrain some dirty gas and move it outwardly to the outlet line. The outlet line is normally released to the atmosphere.

Strict laws prevent the discharge of any pollutants to the atmosphere. Thus, there is a need to eliminate any residual gas to be cleaned remaining in the heat exchanger when it is initially switched to receiving clean gas. Such a need is difficult to achieve with standard regenerative equipment.

On the other hand, the use of the regenerative heat exchangers provides valuable benefits in that it preheats the gas to be cleaned on the way to the combustion chamber. Thus, it is possible to obtain almost complete combustion in a very short period of time. This allows processing of industrial gasses which contain pollutants, such as volatile solvents, in a practical and expedient manner. For that reason, it would not be desirable to eliminate the regenerative function.

One solution to the problem of residual gas is the inclusion of a "purge" system into the regenerative thermal oxidizer. The use of a purge system can be best visualized in a system with at least a third heat exchanger. A first heat exchanger would typically be in an inlet mode receiving a gas to be cleaned, a second heat exchanger is being purged by a clean gas, and a third heat exchanger is in an outlet mode receiving the combusted gas from the combustion chamber. The purge cycle may tap gas from a downstream location on the clean gas and return it through the second heat exchanger and into the combustion chamber. This purge gas drives any residual gas to be cleaned from the heat exchanger and into the combustion chamber where it can be cleaned before being delivered to the atmosphere. Such purge systems have proven effective in reducing the amount of residual gas.

Even so, there may be residual gas left in the regenerative thermal oxidizers on some occasions. Applicant has discovered that in large part, the remaining residual gas may be due to the heat exchange media used in the typical regenerative thermal oxidizers. The use of the saddles or spheroids provides many diverse and partially enclosed spaces to receive the gas; thus, it is quite difficult to thoroughly drive all residual gas to be cleaned from the heat exchange medium.

In addition, since the flow passages vary and have no predictable shape, size or direction, the pressure drop across the heat exchanger may have local variations. The overall pressure drop is typically relatively high. These problems relating to the pressure drop also contribute to residual inlet gas to be cleaned remaining in the heat exchanger.

It is most important to insure that the regenerative thermal oxidizers continue to operate at all times. A primary use of such systems is to process air from paint spray booths to remove volatile solutions or paint vapors from the air prior to discharge to atmosphere. In order to process the maximum amount of air, it is desirable to insure that each heat exchanger is in a inlet mode or an outlet mode for the maximum possible amount of time. Thus, it is desirable to reduce the timing of the purge cycle relative to the inlet and outlet cycles. In regenerative thermal oxidizers the purge cycle typically does not take as long as the inlet or outlet cycles, and thus two of the heat exchangers are more often in an inlet or outlet mode in a standard three heat exchanger regenerative thermal oxidizer. With the prior art heat exchanger media formed of the loose, randomly oriented particles, it was necessary to maintain the purge cycle for an undesirably long period of time. This was due to the fact that the dirty residual air could be found in any of the diverse or partially enclosed spaces defined by the loose heat exchange medium particles, and also due to the problems relating to pressure drop.

SUMMARY OF THE INVENTION

In one disclosed embodiment of the present invention, a heat exchange column structure defines at least one flow passage in a solid body. Preferably this passage extends along an axis of the heat exchange media parallel to the flow of the gas between the inlet and the combustion chamber. In this way, there is little chance that any residual gas will evade the purge gas, and that all inlet gas will be directed into the combustion chamber. Moreover, one may utilize a smaller amount of purge gas increasing the efficiency of the system. Since the passages are clearly defined, the purge gas can quickly and easily purge any residual gas from the heat exchange passages. One need only allow a purge cycle to last for the period of time required for the purge air to move through the heat exchange passage. Since the purge cycle timing can thus be reduced with the inventive structure, one is able to maximize the time that heat exchanger is in the inlet and outlet modes when compared to a purge mode. Such benefits provide unexpected advantages to the regenerative thermal oxidizer environment.

The improved heat transfer column utilized in the regenerative thermal oxidizer of this invention is formed of a heat resistant, heat retaining material having a plurality of relatively small spaced axial gas flow passages. The gas flow passages have a maximum dimension (typically a width or diameter) of less than about one-half inch, or more preferably less than 0.2 inches. In the most preferred embodiment, the passages have a maximum dimension of about 0.05 inches, or even less. The heat transfer column preferably has a substantially constant cross-sectional area throughout its length, wherein the flow passages comprise at least about 40 percent of the cross-sectional area and the pressure drop across the heat transfer column is less than five inches of water, or more preferably less than one inch of water with a superficial flow greater than 100 feet per minute. More preferably, the passages account for fifty to eighty percent of the total cross-sectional area. Most preferably, the passages account for seventy to eighty percent of the total cross-sectional area. As discussed above, the gas flow passages through the heat transfer column are quite small. Preferably, the passages have a substantially constant cross-sectional area of less than 0.1 square inches and extend generally parallel to the flow axis of the heat exchange passages.

In one preferred embodiment, the heat transfer column in the heat exchange passages comprises a plurality of blocks of a heat resistant, heat retaining material, such as a silica alumina ceramic material. Each block includes a plurality of spaced small gas flow passages, and the blocks are stacked in the heat exchange passages with the gas flow passages extending generally parallel to the flow axis of the heat exchange passage and communicate through the heat exchange passage. In this embodiment, the blocks are preferably generally rectangular, each having a plurality of small gas flow passages having a cross-sectional area of less than 0.1 square inches. The outside of the blocks may be sealed within the heat exchange passages by a gasket located between the blocks. In one preferred embodiment, a ceramic rope gasket is wrapped around each of the ceramic blocks, preventing flow of gas around the blocks from bypassing the heat exchange passages.

In another preferred embodiment, the heat exchange column comprises a plurality of tubes formed of a heat resistant, heat retaining material, such as a silica alumina ceramic. Each tube includes an axial bore, and the tubes are stacked within the heat exchangers with the axial bores extending parallel to the flow axis of the heat exchange passages. The inside diameter of the tube bores are preferably less than 0.25 inches, and the combined cross-sectional area of the passages is more than forty percent, preferably fifty to eighty percent, and most preferably, seventy to eight percent.

Alternatively, the heat exchange column or media structure may be a large, monolithic ceramic structure having a plurality of spaced passages extending parallel to the flow axis of the heat exchanger and with each passage preferably having a constant cross-sectional area.

In a typical regenerative thermal oxidizer, the heat exchanger chambers may be as large as eight feet in diameter and eight to ten feet in length or greater, although much smaller regenerators are also used. As will be understood, the size of the regenerator chambers will depend upon the capacity of the unit and may therefore be substantially larger or smaller.

In the prior art regenerative thermal oxidizers, the pressure drop across the heat exchanger media will depend upon the random orientation of the small ceramic elements and the need for cleaning. Dirty or unclean gas is entrapped within the interstices between the small, irregularly-shaped ceramic pieces. However, with the inventive heat exchange column of this invention, one is able to quickly, easily and most assuredly drive any residual gas from the heat exchange media with a minimum amount of purge gas in a minimum purge cycle time. This allows the system to operate with maximum inlet and outlet times on each heat exchanger. This in turn allows the system to process greater amounts of gas to cleaned for a given size heat exchanger and combustion chamber, and for a given time.

These and other features of the present invention may be best understood from the following specification and drawings, of which the following is a brief description.

DETAILED DESCRIPTION OF A PREFERRED EMBODIMENT

Figure 1:
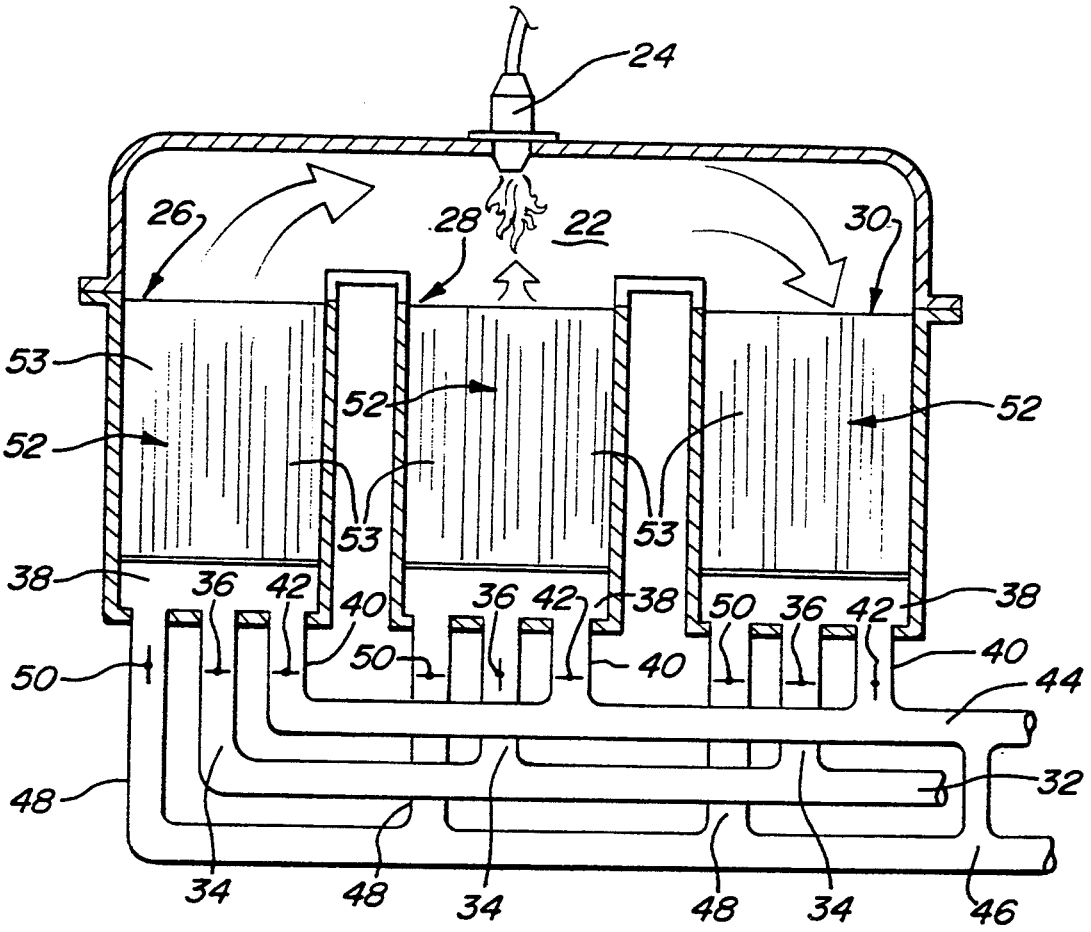
FIG. 1 is a somewhat schematic view of a regenerative thermal oxidizer system.

As illustrated in FIG. 1, regenerative thermal oxidizer 20 has a common combustion chamber 22, including a burner 24. Heat exchangers 26, 28 and 30, alternatively circulate a "dirty" gas to be cleaned into combustion chamber 22, and receive a "clean" gas from combustion chamber 22. The gas preferably flows to an inlet line 32 from a source of gas to be cleaned, and into inlet lines 34, which lead to each of the heat exchangers 26, 28 and 30. Each inlet line 34 passes through an inlet valve 36. An outlet line 40 leads from each of the heat exchangers through an outlet valve 42 and into a common outlet line 44. A purge line 46 taps off gas from outlet line 44 at a location preferably downstream from the last outlet line 40, and returns the gas into a purge line 48 and through a purge valve 50. Purge lines 48, outlet lines 40, and inlet lines 34 all communicate with a chamber 38 at the inlet end of the heat exchangers.

As is known in the art, one of the three heat exchangers, 28 in FIG. 1, is continuously receiving gas from one of the inlet lines 34 by opening inlet valve 36. At the same time, another one of the heat exchangers, 30 in FIG. 1, is delivering gas from combustion chamber 22 through one of the outlet lines 40, by opening outlet valve 42. The third heat exchanger 26 has an open purge valve 50 and closed inlet and outlet valves 36 and 42. Although the disclosed embodiment taps a purge gas from the outlet line, it is also known to use other sources of clean air such as atmospheric air.

Thus, one of the heat exchangers is receiving a cool gas to be cleaned. Another of the heat exchangers is receiving a hot clean gas which heats the heat exchanger. As a previously heated heat exchanger which is receiving the cool gas to be cleaned begins to cool off, the valves are switched and the heat exchanger which had been receiving the combusted clean gas is switched to receiving the inlet gas to be cleaned. The now cool heat exchanger which had been receiving the gas from inlet line 34 is switched into a purge cycle where the clean purge gas purges residual inlet gas in the heat exchanger into the combustion chamber 22. The description of the regenerative thermal oxidizer to this point is as known in the art.

An inventive feature of this invention relates to the heat exchange media utilized in the regenerative thermal oxidizer. As is discussed more fully above in the Background of the Invention section, the gas to be cleaned includes a number of pollutants which must not be allowed to enter the atmosphere. Thus, it is most important to eliminate any residual dirty gas to be cleaned that may remain in a heat exchanger before that heat exchanger is switched to receiving the gas from the combustion chamber.

To this end, applicant has developed the use of a heat exchange column structure 52 having entire passages 53 formed within the heat exchanger structure. In the embodiment illustrated in FIG. 1, heat exchange column 52 is formed as a monolithic ceramic block including a number of passages 53. As shown, passages 53 extend generally parallel to a central axis in the heat exchanger defined between the chamber 38 and combustion chamber 22. Preferably the passages have a cross-section flow area of less than 0.1 square inch.

With the use of the monolithic heat exchange column 52, which defines all of the flow passages in a single element, the flow passages are easily and distinctly defined for the gas. Thus, when the purge gas begins to move the residual gas outwardly of the heat exchanger 26, it is ensured that the purge gas will encounter all gas in the heat exchanger. The residual gas in the system will be in the distinctly defined passages. Further, a small predictable pressure drop will be encountered across passages 53. Thus, a limited amount of purge gas can be utilized and will ensure that all residual gas will be driven from the heat exchanger.

It is important to minimize the amount of purge gas since the purge gas is driven back into the combustion chamber and reduces the efficiency of the system by requiring that one heat exchanger be in a purge cycle, rather in than in an inlet or outlet cycle. In addition, the amount of purge gas driven back into the combustion chamber reduces the volume of the combustion chamber which can be dedicated to cleaning dirty gas. For that reason, applicant's invention, which limits the amount of purge gas which must be utilized, provides unexpected benefits in increasing the efficiency of a regenerative thermal oxidizer system.

Figure 2:
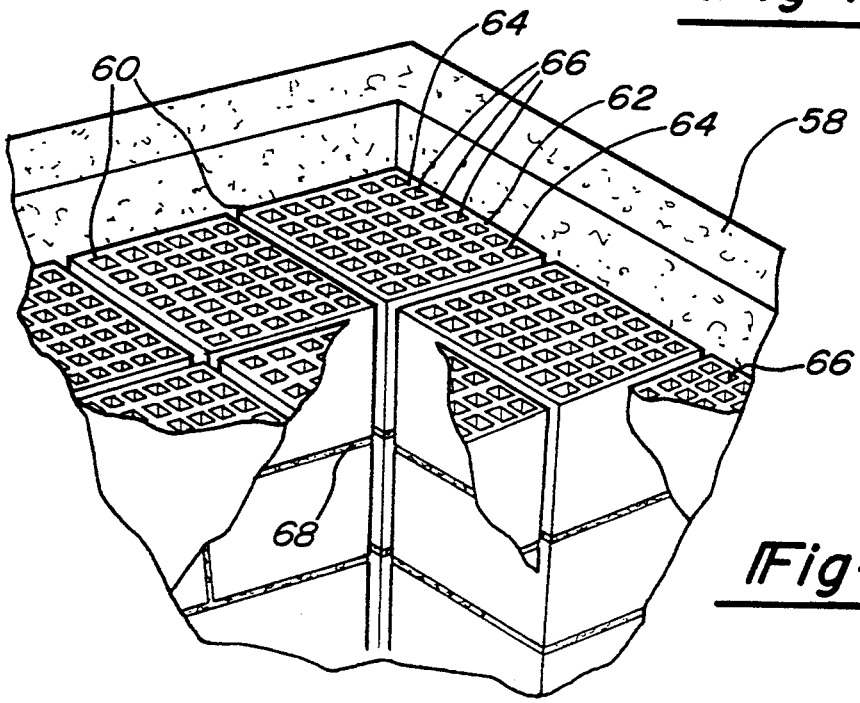
FIG. 2 shows a second embodiment heat exchanger.

As shown in FIG. 2, a second embodiment heat exchange column structure 58 includes a plurality of blocks 60 having walls 62 at their outer periphery and legs 64 forming a number of passages 66 at the center of the blocks. In this embodiment, a gasket 68 is positioned between the adjacent blocks 60. The gasket 68 serves to seal the areas between adjacent blocks. If the blocks are kept to very close tolerances, the gasket may be eliminated in some applications.

It is preferred that the passages on each of the blocks account for 50 to 80 percent of the total cross-sectional area of the blocks, and preferably seventy to eighty percent. The passages preferably have a cross-sectional area of less than 0.1 square inches, and most preferably about 0.05 square inches for a block having an overall length of one to eight feet. The passages are illustrated larger than scale to show their configuration. In a typical application, the blocks have a cross-section of six inches by six inches and a length of two feet. Layers of blocks may be stacked to achieve the overall length. If so, passages 66 are preferably aligned across the stacked layers. The blocks may be extruded from a silica alumina ceramic by conventional means. The blocks are preferably relatively dense to avoid gas receiving voids or interstices. The gasket 68 may be a ceramic rope gasket having a thickness of about one-half inch. Such ceramic ropes are available from several commercial sources.

Figure 3:
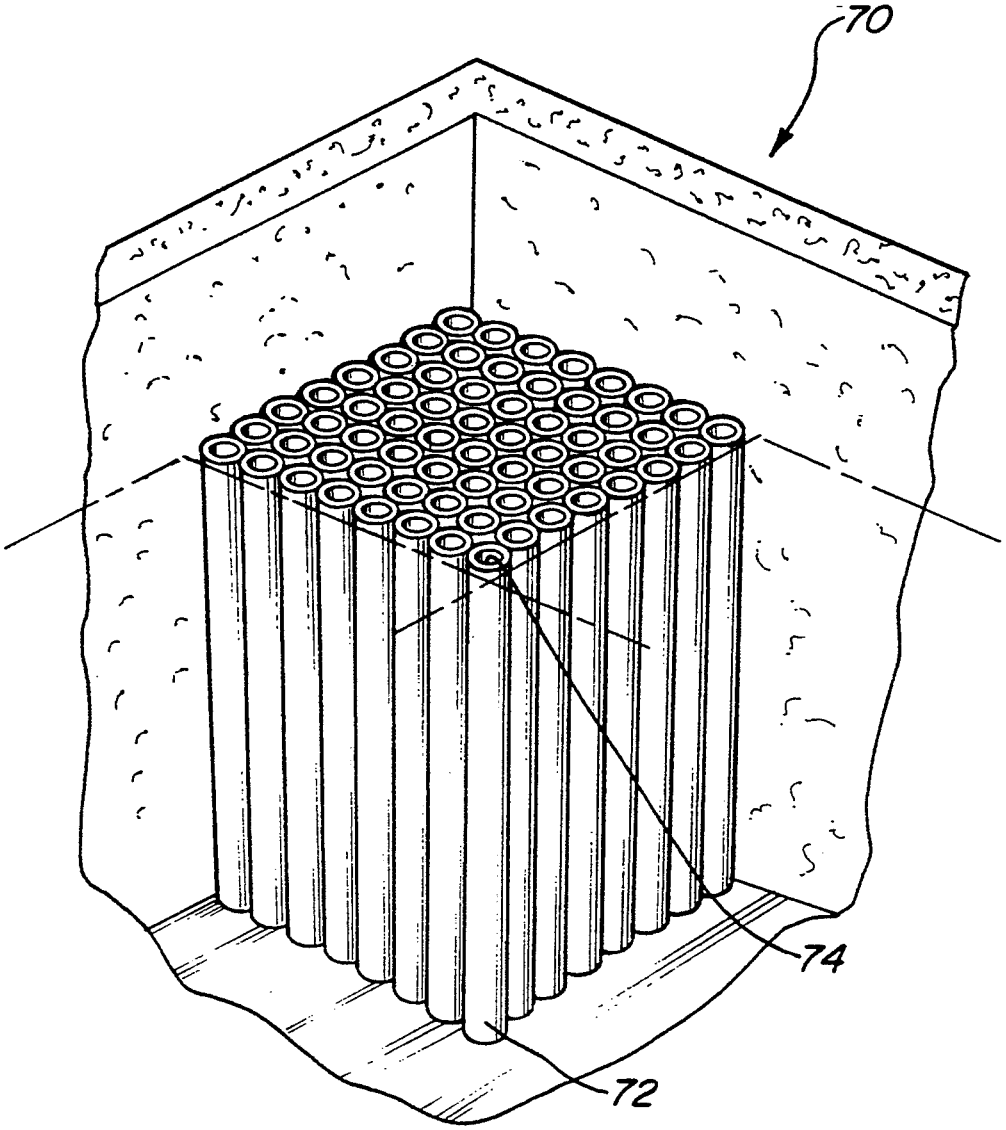
FIG. 3 shows a third embodiment heat exchanger.

In a third embodiment shown in FIG. 3, the heat exchange column structure 70 is formed from a number of cylindrical tubes 72 positioned adjacent to each other. Each cylinder preferably has a central passage 74. Again, it is preferred that the combined cross-sectional area of the passages account for approximately 50 to 80 percent of the total cross-sectional area of the overall heat exchanger media formed in this way, and most preferably 70 to 80 percent. The tubes preferably have an outside diameter of 0.125 inch to 0.5 inch, and an inside bore diameter of 0.06 inch to 0.45 inch. The tubes preferably range in length from one to eight feet depending on the nature of the particular regenerative thermal oxidizer. The tubes may be extruded ceramic tubes, such as silica alumina ceramic. The tubes may be stacked as shown, wherein the gas flows through the tube bores and the space between the tubes. Alternatively, the tubes may be restricted to reduce intertube space, or the space between the tubes may be restricted by a suitable gasket, such as a ceramic rope gasket.

Applicant's three inventive embodiments all provide heat exchange structures which have a solid body defining at least one entire flow passage. Since the flow passages are clearly and distinctively defined, a minimum amount of purge gas is required to drive any residual gas from those flow passages. This in turn provides important benefits in insuring that all residual gas is driven from the heat exchange structure, that a minimum amount of purge gas volume is required, and that a minimum purge gas cycle time is required.

Since the heat flow passages in the several embodiments disclosed in this application are distinct flow passages, the pressure drop across those flow passages is relatively small and predictable. Thus, pressure drops on the order of less than five inches of water with superficial flow rates of 100 feet per minute to 400 feet per minute are expected. More particularly, the pressure drop with a range of superficial flow rates of 100 feet per minute to 400 feet per minute can be expected to be less than one inch of water. This reduces the necessary purge volume which must be utilized to fully drive any residual dirty gas out of the heat exchanger. The term "superficial flow rate" is a flow rate calculated based on the volume of gas moving through the heat exchanger divided by the flow area should there be no blockage by the heat exchanger. Thus, the superficial flow rate is calculated utilizing as the cross-section the entire size of the heat exchanger with no heat exchanger medium received in the heat exchanger. Thus, the actual flow rate is somewhat higher than this superficial flow rate. An important feature of this invention is that the inventive heat exchange media provides a pressure drop of less than one inch of water with a superficial flow rate greater than 100 feet per minute of air flow through the heat exchanger.

The heat exchange columns formed of blocks or tubes may be sintered into a single solid body after assembly. As will be understood, the material used for the heat exchange column media will depend upon the particular application. However, the material must be able to withstand the temperature changes which occur in the regenerators, the temperature of which exceeds 1,000 degrees Fahrenheit and may reach 2,000 degrees Fahrenheit.

Although preferred embodiments of this invention have been disclosed, it should be understood that a worker of ordinary skill in the art would recognize that certain modifications would come within the scope of this invention. For that reason, the following claims should be studied in order to determine the true scope and content of this invention.

What is claimed is:

1. A regenerative thermal oxidizer comprising:

a combustion chamber including a burner;

at least two heat exchangers, each having a heat exchanger passage leading into said combustion chamber and having a heat transfer column located therein;

an inlet line connected to a source of gas having entrained pollutants, said inlet line communicating with an inlet branch leading to each of said heat exchangers, and an inlet valve located in each said inlet branch;

an outlet branch leading from each heat exchanger, each said heat exchanger outlet including an outlet valve;

gas to be cleaned being delivered through said inlet line, and into one of said heat exchanger inlets by opening said inlet valve and closing said outlet valve on one of said heat exchangers in an inlet mode, moving a gas to be cleaned through said one heat exchanger and into said combustion chamber, combusting such gas and leading it from the combustion chamber through a second heat exchanger having a closed inlet valve and an open outlet valve in an outlet mode, and delivering such cleaned gas to said outlet branch;

said heat transfer column including a solid body formed of a heat resistant, heat retaining material having a plurality of spaced axial gas flow passes, said gas flow passages having a maximum dimension of less than about one-half inch, said heat transfer column having a substantially constant cross-sectional area, and said flow passages having a substantially constant cross-sectional area comprising at least about fifty percent of said cross-sectional area, and the pressure drop across said heat transfer column being less five inches of water when the superficial flow rate is greater than 100 feet per minute; and wherein there are at least three of said heat exchangers, and each of said heat exchangers also includes a purge line and a purge valve, said purge line leading to a source of clean air, and said purge valve being opened after said heat exchanger is done receiving a gas to be cleaned, and before said heat exchanger receives said clean gas, the purge acting to purge any residual gas to be cleaned from said heat exchanger passage and into the combustion chamber prior to that heat exchanger receiving a clean gas.

2. The regenerative thermal oxidizer defined in claim 1, wherein said gas flow passages in said heat transfer column have a substantially constant cross-sectional area of less than 0.1 square inches extending through said heat transfer column generally parallel to the flow axis of said heat exchanger passages.

3. The regenerative thermal oxidizer defined in claim 1, wherein said maximum dimension of said gas flow passages is less than 0.1 inches and said heat transfer column has a pressure drop of less than one inch of water.

4. The regenerative thermal oxidizer defined in claim 1, wherein said heat transfer column comprises a plurality of blocks of ceramic material, each block having a plurality of spaced gas flow passages, said blocks stacked in said heat exchanger with said gas flow passages extending generally parallel to the flow axis of said heat exchanger passages and communicating through said heat exchanger passages.

5. The regenerative thermal oxidizer defined in claim 4, wherein said blocks are generally rectangular and said gas flow passages are rectangular, said rectangular gas flow passages each having a maximum width of less than 0.1 inches and said pressure drop across said heat transfer column being less than one inch of water.

6. The regenerative thermal oxidizer defined in claim 5, wherein said blocks are sealed within said heat exchanger passages by a gasket located between said blocks.

7. The regenerative thermal oxidizer defined in claim 6, wherein said gasket is a ceramic gasket wrapped around each of said ceramic blocks preventing flow of gas around said blocks.

8. The regenerative thermal oxidizer defined in claim 1, wherein said heat transfer column comprises a plurality of tubes, each tube formed of a heat resistant, heat retaining material having an axial bore therethrough, said tubes stacked within said heat exchange passages with said tube bores extending parallel to the flow axis of said heat exchange passages, and the inside diameter of said bores being less than 0.25 inches.

9. A regenerative thermal oxidizer as recited in claim 1, wherein said heat exchanger is a monolithic body including a plurality of said gas flow passages.

10. A regenerative thermal oxidizer as recited in claim 3, wherein the surface area of said heat transfer column passages account for 70 to 80 percent of the surface area of said gas flow.

11. A regenerative thermal oxidizer as recited in claim 1, wherein said purge gas is outlet gas.

12. A regenerative thermal oxidizer comprising:

a combustion chamber including a burner;

at least two heat exchangers each having a heat exchanger passage leading into said combustion chamber and having a heat transfer column located therein;

an inlet line connected to a source of gas having entrained pollutants, said inlet line communicating with an inlet branch leading to each of said heat exchangers, and an inlet valve disposed on each said inlet branch;

an outlet branch leading from each heat exchanger, each said outlet branch including an outlet valve;

a purge gas line communicating with a source of clean gas, said purge gas line communicating with purge branches leading to each heat exchanger, and a purge valve mounted on each purge branch;

a gas to be cleaned being delivered through said inlet line, and into one of said inlet branches by opening said inlet valve and closing said outlet valve on one of said heat exchangers in an inlet mode, moving a gas to be cleaned through said one heat exchanger and into said combustion chamber, combusting that gas and leading it from the combustion chamber through a second heat exchanger having a closed inlet valve and an open outlet valve in an outlet mode, and delivering that clean gas to said outlet branch, and said purge gas valve being open on a heat exchanger having a closed inlet valve and closed outlet valve after the heat exchanger has moved from the inlet mode, and before that heat exchanger moves to an outlet mode;

said heat transfer column including a solid body formed of a heat resistant, heat retaining material having a first cross-sectional area and having a plurality of spaced axial gas flow passages, said gas flow passages having a cross-sectional area of less than about 0.1 square inch, and said gas flow passages comprising at least about fifty percent of said first cross-sectional area; and wherein said gas flow passages in said heat transfer column have a substantially constant cross-sectional area and extend through said heat transfer column generally parallel to the flow axis of said heat exchanger passages.

13. A regenerative thermal oxidizer as recited in claim 12, wherein there are at least three of said heat exchangers.

14. The regenerative thermal oxidizer defined in claim 12, wherein said heat transfer column comprises a plurality of blocks of ceramic material, each block having a plurality of spaced gas flow passages, said blocks stacked in said heat exchanger with said gas flow passages extending generally parallel to the flow axis of said heat exchanger passages and communicating through said heat exchanger passages.

15. The regenerative thermal oxidizer defined in claim 12, wherein said heat transfer column comprises a plurality of tubes, each tube formed of a heat resistant, heat retaining material having an axial bore therethrough, said tubes stacked within said heat exchange passages with said tube bores extending parallel to the flow axis of said heat exchange passages, and the inside diameter of said bores being less than 0.25 inches.

16. A regenerative thermal oxidizer as recited in claim 12, wherein said heat exchanger is a monolithic body including a plurality of said gas flow passages.

17. A regenerative thermal oxidizer as recited in claim 12, wherein the surface area of said gas flow passages account for 70 to 80 percent of said first cross-sectional area.

* * * * *